US010184252B2

(12) United States Patent
Stauffer

(10) Patent No.: US 10,184,252 B2
(45) Date of Patent: Jan. 22, 2019

(54) RAIN GUTTER CLEANING TOOL

(71) Applicant: David A. Stauffer, Raleigh, NC (US)

(72) Inventor: David A. Stauffer, Raleigh, NC (US)

( * ) Notice: Subject to any disclaimer, the term of this patent is extended or adjusted under 35 U.S.C. 154(b) by 0 days.

(21) Appl. No.: 15/786,863

(22) Filed: Oct. 18, 2017

(65) Prior Publication Data

US 2018/0106045 A1 Apr. 19, 2018

Related U.S. Application Data

(60) Provisional application No. 62/409,784, filed on Oct. 18, 2016.

(51) Int. Cl.
*E04D 13/076* (2006.01)

(52) U.S. Cl.
CPC ..... *E04D 13/0765* (2013.01)

(58) Field of Classification Search
CPC . E04D 13/0765; E04D 13/106; E04D 15/003; E04D 15/006
USPC ..... 15/105, 236.04; 294/2, 219, 24, 15, 175, 294/182, 51, 176, 180, 181, 209–211; 81/45, 488; D8/7, 10, 11, 105; D32/42, D32/51, 35, 49; 7/166, 169, 170, 114, 7/116; 172/371, 372, 375–377
See application file for complete search history.

(56) References Cited

U.S. PATENT DOCUMENTS 801,978 A * 10/1905 Garner ..... 172/375
897,293 A * 9/1908 Korpi ..... 7/109
1,156,714 A * 10/1915 Schroeder et al. .... A01B 1/222 172/373
1,438,095 A * 12/1922 Clark ..... A01G 3/06 172/13
1,669,339 A * 5/1928 Johnson ..... B61K 11/00 7/169
1,998,314 A * 4/1935 Gilstrap ..... A01B 1/16 254/132
3,710,407 A * 1/1973 Reid ..... B21D 1/06 7/144
3,893,200 A * 7/1975 Wanciak ..... B25F 1/00 7/166
4,194,780 A * 3/1980 Dilley ..... E04D 13/0765 15/236.04
D477,523 S * 7/2003 Malvasio ..... D8/105
D670,881 S * 11/2012 Tonge ..... D32/49
2003/0051305 A1* 3/2003 Hewlett ..... E04D 13/0765 15/236.04
2009/0283281 A1* 11/2009 Lewis ..... A01B 1/08 172/375
2017/0260749 A1* 9/2017 Chase ..... E04D 13/0765

* cited by examiner

*Primary Examiner* — Mark Spisich

(57) ABSTRACT

A rain gutter cleaning tool has a scraper portion and a hook portion connected on opposite sides of a main body portion, as well as a tool attachment portion. The scraper portion is used to maneuver debris within a rain gutter to within the user's reach, while the hook portion is used to maneuver debris underneath gutter hangers which provide obstacles to the use of the scraper portion. The tool attachment portion is internally threaded to accommodate an extension pole. Thus, the user is able to easily and effectively clear a significant portion of a rain gutter without having to climb down from a ladder and move the ladder to a new spot in order to bring more debris within their reach for cleaning.

14 Claims, 5 Drawing Sheets

RAIN GUTTER CLEANING TOOL

The current application claims a priority to the U.S. Provisional Patent application Ser. No. 62/409,784 filed on Oct. 18, 2016.

FIELD OF THE INVENTION

The present invention relates generally to maintenance tools. More particularly, the present invention relates to cleaning of rain gutters.

BACKGROUND OF THE INVENTION

Many buildings, particularly residential homes, have rain gutters surrounding the edges of their roofs for facilitating water discharge. Gutters prevent ingress into the fabric of a building by channeling rainwater away from the exterior of the walls and their foundations. In one common configuration, water from a pitched roof flows into a trough, typically made of metal, that is suspended beyond the roof edge and below the projected slope of the roof. Water collected by the gutter flows into a downpipe, which eventually discharges the collected water at a sufficient distance away from the walls of the structure.

Rain gutters may often become clogged by debris, particularly falling leaves from surrounding trees. In this case, the entrance to the downspout may become obstructed, resulting in the failure of the gutter to perform its intended function. Gutter cleaning is a necessary part of home maintenance, and current tools that assist users in doing so don't effectively allow users to pull the debris under the gutter hangars without moving their ladder. Most, if not all, similar tools also can't safely hang on any extension ladder, making users hold onto them while on the ladder. It is therefore an objective of the present invention to address these issues by providing users with a gutter cleaning tool that is more efficient and offers more functions than similar tools today

DETAIL DESCRIPTIONS OF THE INVENTION

Figure 1:
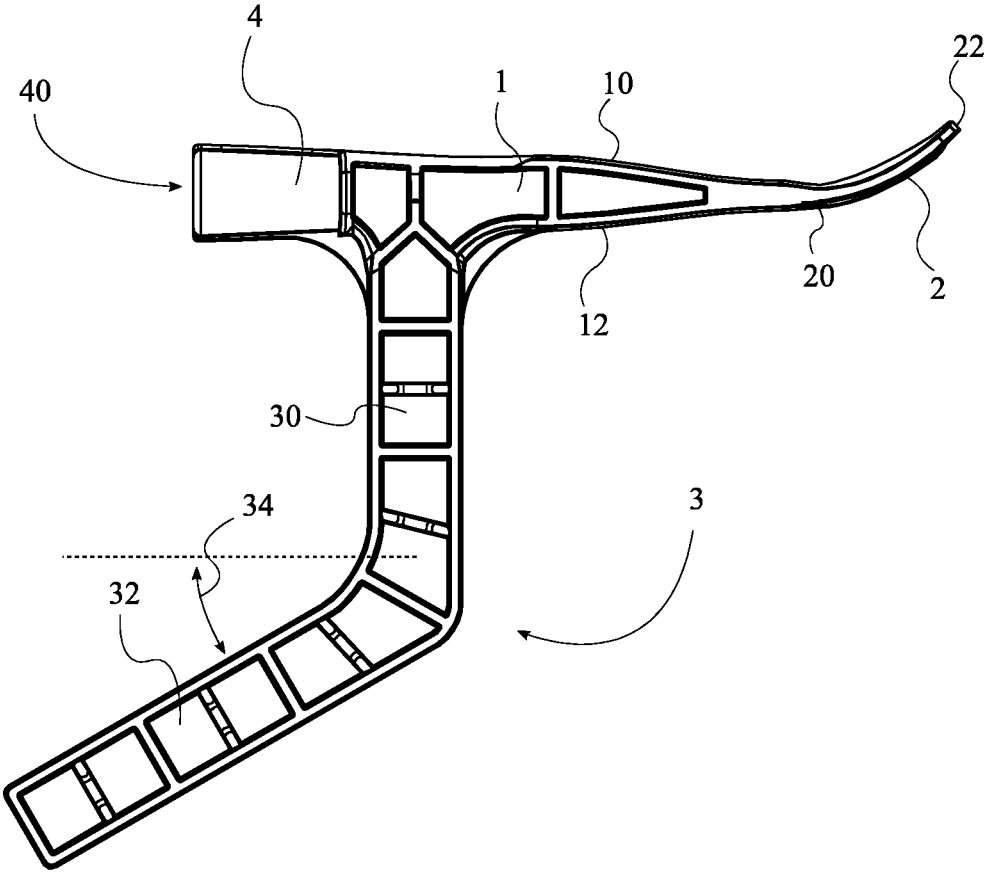
FIG. 1 is a side view of the present invention.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

The present invention is a tool for use by homeowners or professional gutter cleaning personnel to facilitate ease of clearing debris from rain gutters of a house or other type of building with rain gutters. The present invention enables the user to remove debris in a large radius around their person, thus reducing the need to climb down from a ladder, move the ladder to a new location and climb back up the ladder in order to reach uncleared portions of the rain gutters.

Referring to FIGS. 1-4, generally, the present invention comprises a main body portion 1, a scraper portion 2, a hook portion 3, and a tool attachment portion 4. The main body portion 1 may be regarded as a central structural body to which other components are attached and through which the various functionalities of the present invention are thus achieved. The scraper portion 2 is terminally connected to the main body portion 1, and the tool attachment portion 4 is terminally connected to the main body portion 1 opposite the scraper portion 2 along the main body portion 1. Furthermore, the hook portion 3 is angularly connected to the main body portion 1 between the tool attachment portion 4 and the scraper portion 2.

The present invention may be manufactured in any useful and desirable means, such as, but not limited to, plastic injection molding, additive manufacturing, computer numerical control (CNC) machining, hand operated machining, or any other manufacturing process. Furthermore, the main body portion 1, the hook portion 3, the scraper portion 2, and the tool attachment portion 4 may be manufactured from any desirable material, such as, but not limited, to, plastic material, metal material, or any other type of material. It is further contemplated that various components of the present invention may be made of different materials than other components. For example, the main body portion 1 may be made of a plastic material, while the scraper portion 2 may be made of a metal material.

The present invention generally intends to provide two main functionalities to the user. Firstly, the scraper portion 2 is used to pull debris within the gutter toward the user, so that the user may manually remove the debris from the gutter with their hand or through other means or implement, such as a vacuum tool. However, a problem is presented to the user, as many gutters are affixed to the edge of a roof by gutter hangers which wrap completely around the gutter, thus providing an obstacle to the user desiring to pull debris past the hangers to a point within their reach. Thus, the second main functionality is provided by the hook portion 3. The hook portion 3 is shaped and configured in such a manner that the user is able to insert a free end of the hook portion 3 beneath a gutter hangar and pull the tool toward themselves, thus forcing debris underneath and past the gutter hanger obstacle.

It is contemplated that the scraper portion 2 may be comprised in a variety of different manners, forms, shapes, sizes and configurations, so long as the functionality of being able to adequately pull debris toward the user is maintained. As such, the scraper portion 2 may be spoon-shaped, or the scraper portion 2 may be triangular shaped, or the scraper portion 2 may comprise a plurality of tines similar to a rake or fork, or the scraper portion 2 may be generally L-shaped, or the scraper portion 2 may be embodied in any other desirable form.

In some embodiments, the scraper portion 2 comprises a proximal end 20 and a distal end 22, with the scraper portion 2 extending from the proximal end 20 to the distal end 22. The proximal end 20 is connected to the main body portion 1, and the scraper portion 2 is curved from the proximal end 20 to the distal end 22. In order to not interfere with each other, the scraper portion 2 and the hook portion 3 should be positioned on opposite sides of the main body. Thus, in some embodiments, the distal end 22 is positioned opposite the hook portion 3 across the main body, due to the curvature of the scraper portion 2 away from a centerline of the main body portion 1. Alternatively described, the main body portion 1 may comprise a first side 10 and a second side 12 positioned opposite each other on the main body portion 1, wherein the proximal end 20 of the scraper portion 2 is positioned adjacent to the first side 10, wherein the distal end 22 of the scraper portion 2 is separated from the first side 10 by a certain distance, opposite the second side 12, and wherein the hook portion 3 is positioned adjacent to the second side 12.

Figure 2:
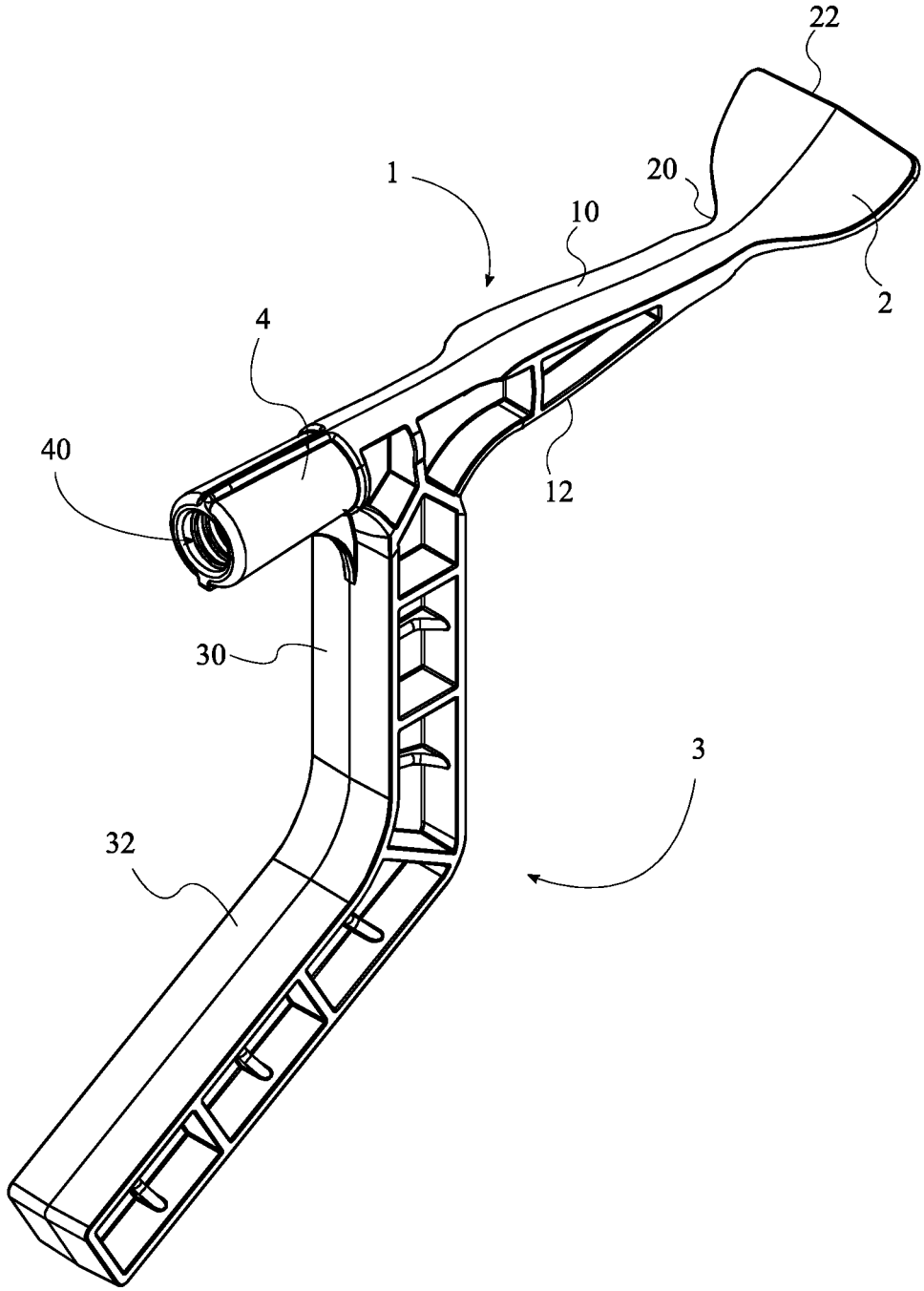
FIG. 2 is an elevated perspective view of the present invention.
Figure 3:
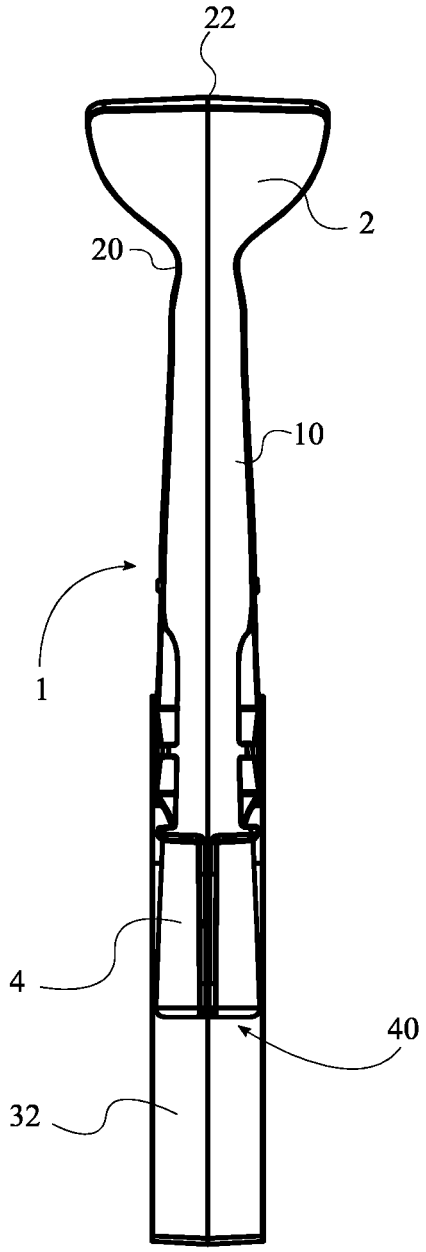
FIG. 3 is a top view of the present invention.
Figure 4:
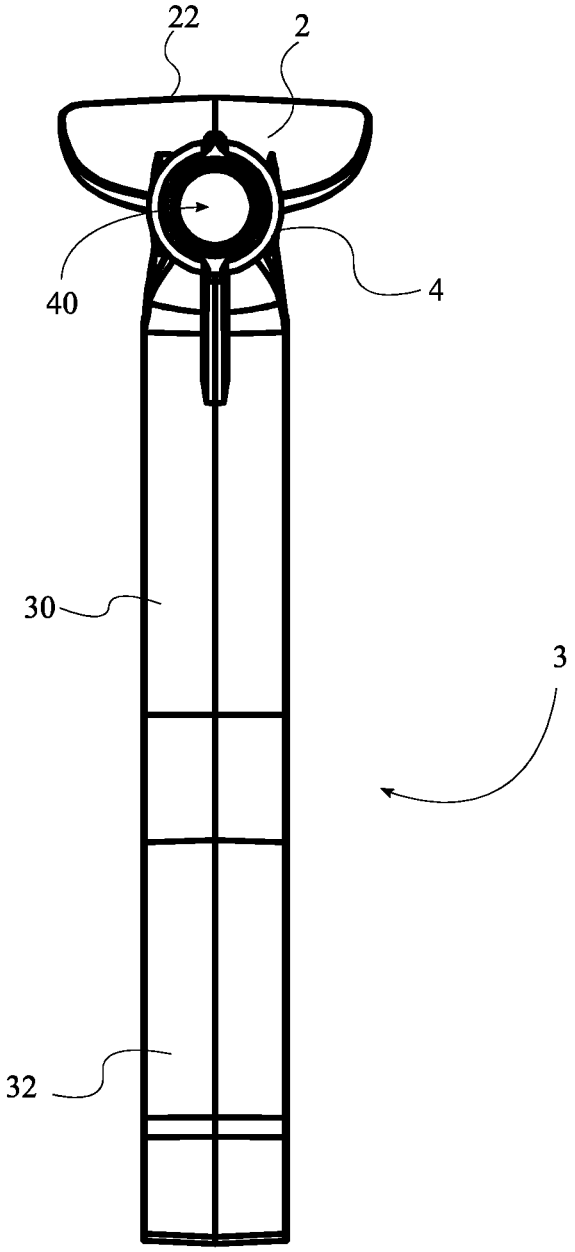
FIG. 4 is a rear view of the present invention.

In some embodiments, as can be seen in FIGS. 2-3, the proximal end 20 of the scraper portion 2 may have a width similar to the main body portion 1, while the distal end 22 has a width larger than the width of the proximal end 20. For example, the width of the distal end 22 may be greater than the width of the proximal end 20 by a factor of three. Furthermore, it is contemplated that in some embodiments the scraper portion 2 may be removable from the main body portion 1 in order to attach alternatively shaped or configured scraper portion 2*s* to the main body portion 1 according to user preference or various different applications.

As previously discussed, the hook portion 3 enables the user to maneuver debris under a gutter hanger, an action which would be difficult to accomplish utilizing the scraper portion 2 alone. The hook portion 3 should be configured to generally be an open-ended hook or loop, such that the free end is facing the user, wherein the free end is abutted against the debris while pulling the debris under the gutter hanger. Furthermore, in addition to maneuvering debris, the hook portion 3 provides a secondary benefit to the user in being able to be conveniently hung on a rung of a ladder while the user ascends the ladder, thus allowing the user to use both of their hands while climbing for optimal safety.

In some embodiments, the hook portion 3 may resemble half a U-shape. In some embodiments, the hook portion 3 comprises a first angled body portion 30 and a second angled body portion 32. The first angled body portion 30 is angularly connected to the main body portion 1 between the scraper portion 2 and the tool attachment portion 4. In some embodiments, the first angled body portion 30 is positioned adjacent to the tool attachment portion 4, and in some embodiments the first angled body portion 30 is perpendicularly connected to the main body portion 1. Furthermore, the second angled body portion 32 is angularly connected to the first angled body portion 30 opposite the main body portion 1 at a specified hook angle 34 to the main body portion 1, as illustrated in FIG. 1. In some embodiments, the specified hook angle 34 is 30 degrees from parallel with the main body portion 1. In some embodiments, the specified hook angle 34 is between 20 degrees and 70 degrees from parallel with the main body portion 1. In any case, it is generally desirable for the second angled body portion 32 to be oriented at an acute angle relative to the main body portion 1. This is to accommodate for the fact that the user is likely to be utilizing the present invention at an angle above the gutter, and thus the second angled body portion 32 is closer to horizontal relative to the gutter for ease of maneuvering debris within the gutter.

Figure 5:
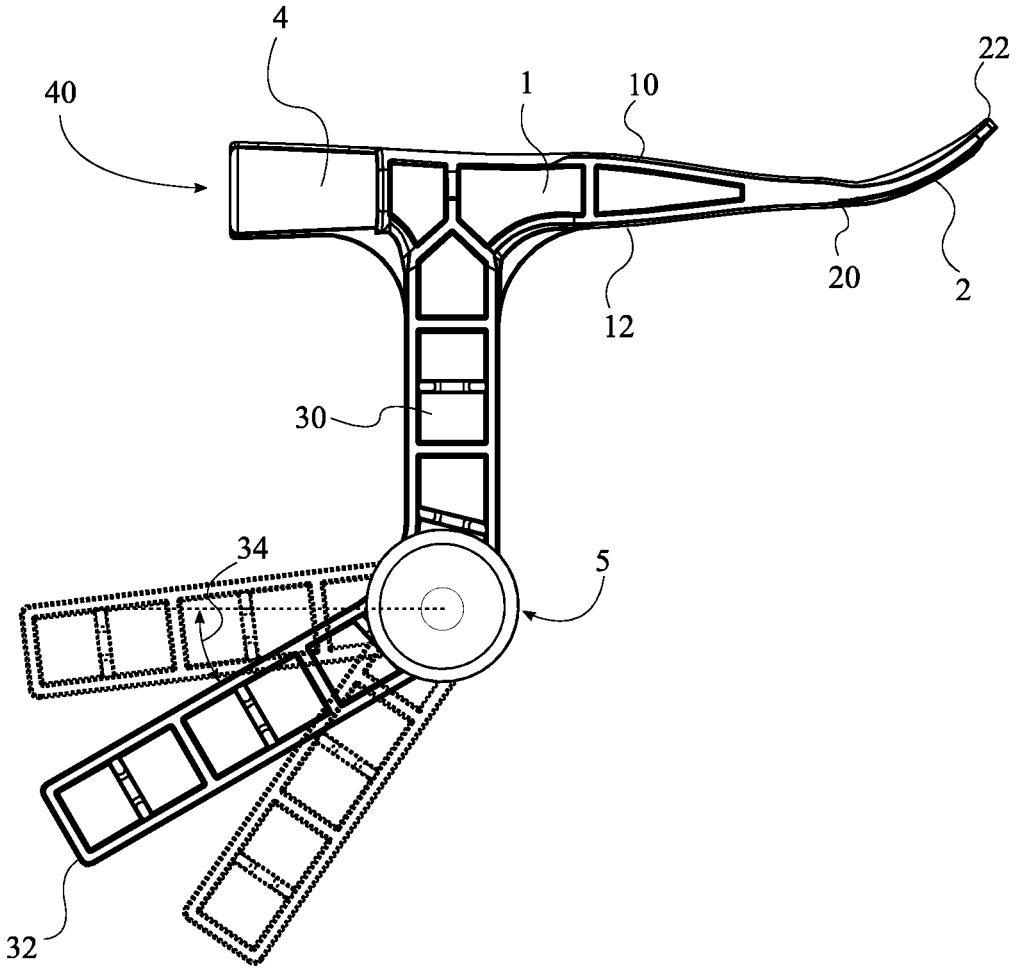
FIG. 5 is a side view of the present invention illustrating an angle adjustment mechanism.

Referring to FIG. 5, in some embodiments, the present invention may comprise an angular adjustment mechanism 5 in order to adjust hook portion 3 according to user preference. Thus, in some embodiments, the second angled body portion 32 is connected to the first angled body portion 30 through the angular adjustment mechanism 5, wherein the angular adjustment mechanism 5 adjusts a specified hook angle 34 between the first angled body portion 30 and the second angled body portion 32. FIG. 5 illustrates various angular positioning of the second angled body portion 32 relative to the first angled body portion 32 through the adjustment mechanism 5. In some embodiments, the angular adjustment mechanism 5 may alternatively or additionally connect the first angled body portion 30 to the main body portion 1.

In some embodiments, the tool attachment portion 4 is permanently connected to a pole. However, in the preferred embodiment of the present invention, the tool attachment portion 4 is configured to be attached to an extension pole. The extension pole may be a currently available commercial product, or the extension pole may be a new item. It is contemplated that any one of a variety of attachment mechanisms may be utilized as desired or appropriate without significantly altering the spirit and functionality of the present invention. In some embodiments, the tool attachment portion 4 comprises a threaded end 40, wherein the threaded end 40 is positioned opposite the main body portion 1 along the tool attachment portion 4. In some embodiments, the threaded end 40 is internally threaded. For example, the threaded end 40 may be internally threaded to accommodate external ACME threading as is commonly found on current extension poles on the market in any desired dimensions. In some embodiments, the threaded end 40 may be externally threaded in order to attach extension poles which have an internally threaded end 40 as opposed to an externally threaded end 40.

Although the invention has been explained in relation to its preferred embodiment, it is to be understood that many other possible modifications and variations can be made without departing from the spirit and scope of the invention as hereinafter claimed.

What is claimed is:

1. A rain gutter cleaning tool comprises:

a main body portion;

a scraper portion;

a hook portion;

a tool attachment portion;

the scraper portion being terminally connected to the main body portion;

the tool attachment portion being terminally connected to the main body portion opposite the scraper portion along the main body portion;

the hook portion being angularly connected to the main body portion between the tool attachment portion and the scraper portion;

the hook portion comprises a first angled body portion and a second angled body portion;

the first angled body portion being angularly connected to the main body portion between the scraper portion and the tool attachment portion;

the second angled body portion being angularly connected to the first angled body portion opposite the main body portion at a specified hook angle;

an angular adjustment mechanism; and the second angled body portion being connected to the first angled body portion through the angular adjustment mechanism, wherein the angular adjustment mechanism adjusts a specified hook angle between the first angled body portion and the second angled body portion.

2. The rain gutter cleaning tool as claimed in claim 1 comprises:

the scraper portion comprises a proximal end and a distal end;

the scraper portion extending from the proximal end to the distal end;

the proximal end being connected to the main body portion; and the scraper portion being curved from the proximal end to the distal end.

3. The rain gutter cleaning tool as claimed in claim 2 comprises:

the distal end being positioned opposite the hook portion across the main body.

4. The rain gutter cleaning tool as claimed in claim 1 comprises:

the scraper portion being spoon-shaped.

5. The rain gutter cleaning tool as claimed in claim 1 comprises:

the scraper portion being triangularly shaped.

6. The rain gutter cleaning tool as claimed in claim 1 comprises:

the first angled body portion being positioned adjacent to the tool attachment portion.

7. The rain gutter cleaning tool as claimed in claim 1 comprises:

the first angled body portion being perpendicularly connected to the main body portion.

8. The rain gutter cleaning tool as claimed in claim 1 comprises:

the specified hook angle being 30 degrees.

9. The rain gutter cleaning tool as claimed in claim 1 comprises:

the specified hook angle being between 20 degrees and 70 degrees.

10. The rain gutter cleaning tool as claimed in claim 1 comprises:

the tool attachment portion being configured to be attached to an extension pole.

11. The rain gutter cleaning tool as claimed in claim 1 comprises:

the tool attachment portion comprises a threaded end; and the threaded end being positioned opposite the main body portion along the tool attachment portion.

12. The rain gutter cleaning tool as claimed in claim 11 comprises:

the threaded end being internally threaded.

13. The rain gutter cleaning tool as claimed in claim 1 comprises:

the main body portion, the hook portion, the scraper portion, and the tool attachment portion being manufactured from a plastic material.

14. The rain gutter cleaning tool as claimed in claim 1 comprises:

the main body portion, the hook portion, the scraper portion, and the tool attachment portion being manufactured from a metal material.

* * * * *